US006213014B1

(12) United States Patent
Motoe et al.

(10) Patent No.: US 6,213,014 B1
(45) Date of Patent: Apr. 10, 2001

(54) STENCIL PRINTER HAVING PRINTING DRUM AND RETAINER ROLLER

(75) Inventors: Katsuro Motoe; Koji Nakayama, both of Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/407,896

(22) Filed: Sep. 29, 1999

(30) Foreign Application Priority Data

Oct. 1, 1998 (JP) ..... 10-279985

(51) Int. Cl.[7] ..... B41L 13/06
(52) U.S. Cl. ..... 101/116; 101/120
(58) Field of Search ..... 101/116, 119, 101/120

(56) References Cited

U.S. PATENT DOCUMENTS 5,255,599 * 10/1993 Kobayasi et al. ..... 101/116
5,619,918 * 4/1997 Negishi et al. ..... 101/116

FOREIGN PATENT DOCUMENTS 0 653 307 A2 5/1995 (EP) .
246794 * 8/1926 (GB) ..... 101/116

* cited by examiner

*Primary Examiner*—John S. Hilten
*Assistant Examiner*—Leslie J. Grohusky
(74) *Attorney, Agent, or Firm*—Nixon Peabody LLP; Donald R. Studebaker

(57) ABSTRACT

A stencil printer has a printing drum which has an ink-permeable peripheral wall around which a stencil master is wound and to the inner surface of which ink is supplied. The printing drum is rotated about its longitudinal axis. An internal press roller is disposed inside the printing drum and is rotated in contact with the inner surface of the peripheral wall of the printing drum. A paper pinch drum is disposed outside the printing drum and is pressed against the peripheral wall of the printing drum with a printing paper pinched between the pinching means and the stencil master wound around the peripheral wall. A retainer roller is disposed in a predetermined position near the internal press roller and the inner surface of the peripheral wall downstream of the contact line between the internal press roller and the inner surface of the peripheral wall in the direction of rotation of the printing drum.

10 Claims, 10 Drawing Sheets

STENCIL PRINTER HAVING PRINTING DRUM AND RETAINER ROLLER

BACKGROUND OF THE INVENTION

1. Field of the Invention

This invention relates to a stencil printer which comprises a printing drum, an internal press roller provided inside the printing drum to be brought into contact with the inner surface of the printing drum and a pinching means which is provided outside the printing drum and is pressed against the peripheral wall of the printing drum with a printing paper pinched therebetween, and more particularly to such a stencil printer in which the peripheral wall of the printing drum is prevented from being deformed inward through contact with the internal press roller.

2. Description of the Related Art

The structure of the conventional stencil printer and the drawbacks of the stencil printer will be described with reference to FIG. 12, hereinbelow. As shown in FIG. 12, the conventional stencil printer comprises a printing drum 200 having a cylindrical peripheral wall. The peripheral wall is permeable to ink and a stencil master is wound around the peripheral wall. The printing drum 200 is rotated about its longitudinal axis. Am arm 202 which is rotatable about a fixed shaft 201 is provided inside the printing drum 200. An internal press roller 203 is mounted for rotation on the arm 202. A doctor roller 205 is disposed near the internal press roller 203. The doctor roller 205 forms an ink layer of a predetermined thickness on the outer surface of the internal press roller 203. The arm 202 is rotated in synchronization with rotation of the printing drum 200 so that the internal press roller 203 presses outward the peripheral wall of the printing drum 200. A paper pinch drum 206 is supported for rotation at a predetermined distance from the printing drum 200. When a printing paper is supplied between the printing drum 200 and the paper pinch drum 206, the internal press roller 203 deforms outward the peripheral wall of the printing drum 200 and the printing paper is conveyed pinched between the stencil master on the deformed part of the peripheral wall and the paper pinch drum 206, whereby ink supplied from the internal press roller 203 to the inner surface of the peripheral wall of the printing drum 200 passes through the peripheral wall of the printing drum 200 and the stencil master and is transferred to the printing paper to form an image.

In the conventional stencil printer shown in FIG. 12, there has been a problem that a part of the peripheral wall of the printing drum 200 adheres to the internal press roller 203 and is deformed inward as indicated at D in FIG. 12. This phenomenon occurs on the downstream side of the contact line between the outer surface of the internal press roller 203 and inner surface of the peripheral wall of the printing drum 200 and occurs due to the fact that a part of the inner surface of the peripheral wall of the printing drum 200 cannot be properly separated from the outer surface of the internal press roller 203 after the part passes through the contact line between the internal press roller 203 and the paper pinch drum 206.

Accordingly, this phenomenon is more apt to occur when the peripheral wall of the printing drum 200 is deformable or when the ink has a high viscosity. This phenomenon is especially apt to occur under a low temperature where the viscosity of the ink increases. This phenomenon can occur not only in the conventional stencil printer where the peripheral wall of the printing drum 200 is flexible but also in stencil printers where the peripheral wall of the printing drum is rigid. This is because the thickness of the rigid peripheral wall of the printing drum is made as thin as possible in order to reduce the amount of ink held by the printing drum so that printing quality is improved. For example, when the peripheral wall of the printing drum is formed of a stainless steel plate which is about 0.15 mm in thickness, the aforesaid deformation of the peripheral wall can occur depending on the conditions.

The aforesaid deformation of the peripheral wall of the printing drum can cause the following problems. That is, when the peripheral wall of the printing drum is deformed, the stencil master attached on the outer surface of the peripheral wall can be stretched or displaced in the circumferential direction of the printing drum. Further when the peripheral wall is repeatedly deformed and is repeatedly subjected to stress, the peripheral wall can be broken at the part where the stress is concentrated. Further repeated deformation of the peripheral wall can finally result in plastic deformation of the peripheral wall, e.g., the peripheral wall can corrugate as seen in a cross-section parallel to the longitudinal axis of the printing drum. Further when the peripheral wall is finally moved away from the internal press roller under its resiliency, ink splashes mechanisms in the printing drum.

SUMMARY OF THE INVENTION

In view of the foregoing observations and description, the primary object of the present invention is to provide a stencil printer in which deformation of the peripheral wall of the printing drum can be suppressed, whereby the stencil master wound around the peripheral wall of the printing drum is stabilized, durability of the peripheral wall is increased and ink is prevented from splashing.

In accordance with the present invention, there is provided a stencil printer comprising

- a printing drum which has an ink-permeable peripheral wall, around which a stencil master is wound and to the inner surface of which ink is supplied, and is rotated about its longitudinal axis,
- an internal press roller which is disposed inside the printing drum and is in contact with the inner surface of the peripheral wall of the printing drum,
- a pinching means which is disposed outside the printing drum and carries a printing paper with pinching the printing paper between the pinching means and the stencil master wound around the peripheral wall, and
- a retainer roller which is disposed in a predetermined position near the internal press roller and the inner surface of the peripheral wall downstream of the contact line between the internal press roller and the inner surface of the peripheral wall in the direction of rotation of the printing drum.

In one embodiment of the present invention, the internal press roller is mounted on a rotatable member disposed inside the printing drum to be movable, in response to rotation of the rotatable member, between an inoperative position where it is away from the peripheral wall of the printing drum and an operative position where it presses outward the peripheral wall, the pinching means is a rotatable paper pinch drum which is disposed outside the printing drum at such a distance from the printing drum that the printing paper is pinched between the peripheral wall of the printing drum and the paper pinch drum when the internal press roller deforms outward the side, and the retainer roller is mounted for rotation on the rotatable member.

In another embodiment of the present invention, the internal press roller is mounted on a rotatable member disposed inside the printing drum to be movable, in response to rotation of the rotatable member, between an inoperative position where it is away from the peripheral wall of the printing drum and an operative position where it presses outward the peripheral wall, the pinching means is a rotatable paper pinch drum which is disposed outside the printing drum at such a distance from the printing drum that the printing paper is pinched between the peripheral wall of the printing drum and the paper pinch drum when the internal press roller deforms outward the side, and the retainer roller is mounted for rotation on a rotatable arm which is mounted for rotation on the rotatable member and is urged by an urging means toward the inner surface of the peripheral wall of the printing drum.

In still another embodiment of the present invention, the pinching means is an external press roller which is movable up and down between an operative position in which it is pressed against the peripheral wall of the printing drum with a printing paper pinched therebetween and an inoperative position where it is away from the printing drum, and the retainer roller is supported for rotation.

In still another embodiment of the present invention, the pinching means is an external press roller which is movable up and down between an operative position in which it is pressed against the peripheral wall of the printing drum with a printing paper pinched therebetween and an inoperative position where it is away from the printing drum, and the retainer roller is movable upward from the predetermined position and is urged toward the predetermined position.

Generally the retainer roller is normally spaced from the inner surface of the peripheral wall.

The retainer roller may be rotated in the same direction as the internal press roller.

The retainer roller may be of various shapes. For example, the retainer roller may be a cylindrical member having a uniform outer diameter or a spindle-shaped member. Further the retainer roller may comprise a plurality of roller sections which are coaxially mounted.

DESCRIPTION OF THE PREFERRED EMBODIMENTS

Figure 1:
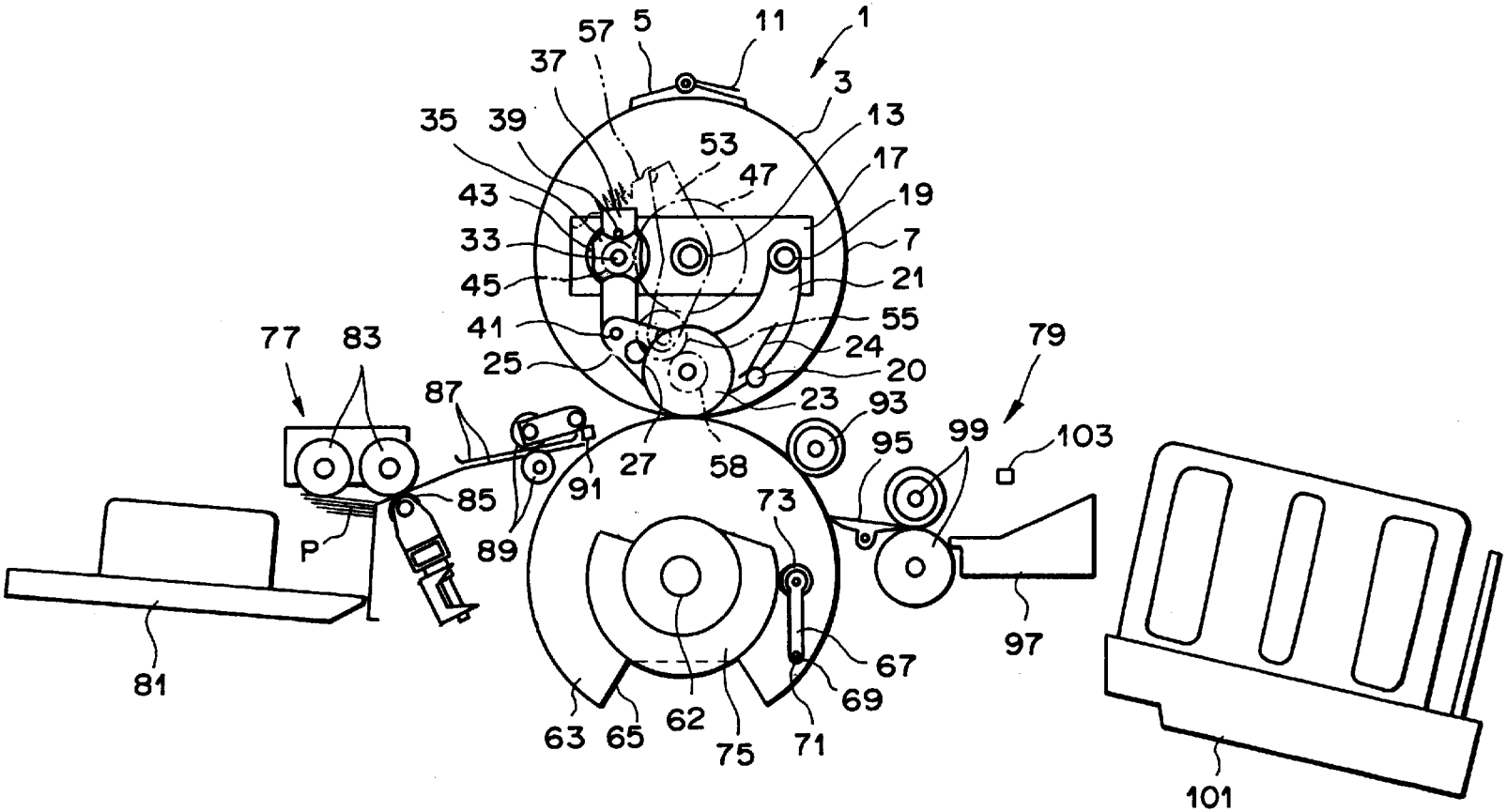
FIG. 1 is a schematic side view of a stencil printer in accordance with a first embodiment of the present invention in a state where the squeegee roller is in the operative position.

A stencil printer in accordance with a first embodiment of the present invention will be described in detail with reference to FIGS. 1 to 6, hereinbelow.

In FIGS. 1 to 6, the stencil printer of this embodiment has a printing drum 1 comprising a pair of disc-like rigid end plates 3 opposed to each other in the longitudinal direction of the printing drum 1, a rigid clamp base plate 5 which extends in parallel to the longitudinal axis of the printing drum 1 and connects the end plates 3, and a cylindrical peripheral wall 7 wound around the side plates 3.

The peripheral wall 7 is formed by weaving wire such as of stainless steel into a mesh-like structure and accordingly is flexible and ink-permeable. By virtue of such a structure, the peripheral wall 7 can be deformed outward in a radial direction of the printing drum 1.

A clamp plate 11 which clamps the leading end portion of a stencil master is mounted for rotation on the clamp base plate 5. The stencil master is wound around the peripheral wall 7 of the printing drum 1 with its leading end clamped by the clamp plate 11.

The printing drum 1 is supported for rotation on a tubular drum shaft 13 which extends through the printing drum 1 along its longitudinal axis. Each of the end plates 3 is formed with a gear 15 on its circumferential surface and the gear 15 is in mesh with a drive gear of a printing drum drive motor (not shown). The printing drum 1 is rotated in the counterclockwise direction as seen in FIG. 1 by the printing drum drive motor about the drum shaft 13 which is fixed.

An in-drum frame 17 is fixedly supported in the printing drum 1 by the drum shaft 13. A pair of roller support arms 21 are connected to the in-drum frame 17 by way of pivot shafts 19 at their one ends so that the roller support arms 21 are rotatable up and down. A squeegee roller 23 (an internal press roller) is supported for rotation on intermediate portions of the roller support arms 21. The squeegee roller 23 extends in parallel to a generatrix of the printing drum 1 and the side surface of the squeegee roller 23 is brought into contact with the inner surface of the peripheral wall 7 of the printing drum 1.

A doctor rod 25 extends in parallel to the squeegee roller 23 at a slight distance therefrom and is fixed to the roller support arms 21 at its opposite ends. An ink fountain 27 is formed between the squeegee roller 23 and the doctor rod 25. An ink delivery pipe 29 supplies ink to the ink fountain 27. The ink delivery pipe 29 is connected to an ink hose 31 which extends through the tubular drum shaft 13 to the outside of the printing drum 1 and is connected to an ink source (not shown).

Ink in the ink fountain 27 is caused to pass the narrow space between the squeegee roller 23 and the doctor rod 25 by counterclockwise rotation of the squeegee roller 23 and is metered. Thus ink adheres to the outer surface of the squeegee roller 23 in a layer of a predetermined thickness and is squeezed into the inner surface of the peripheral wall 7 as the squeegee roller 23 rotates.

Figure 4:
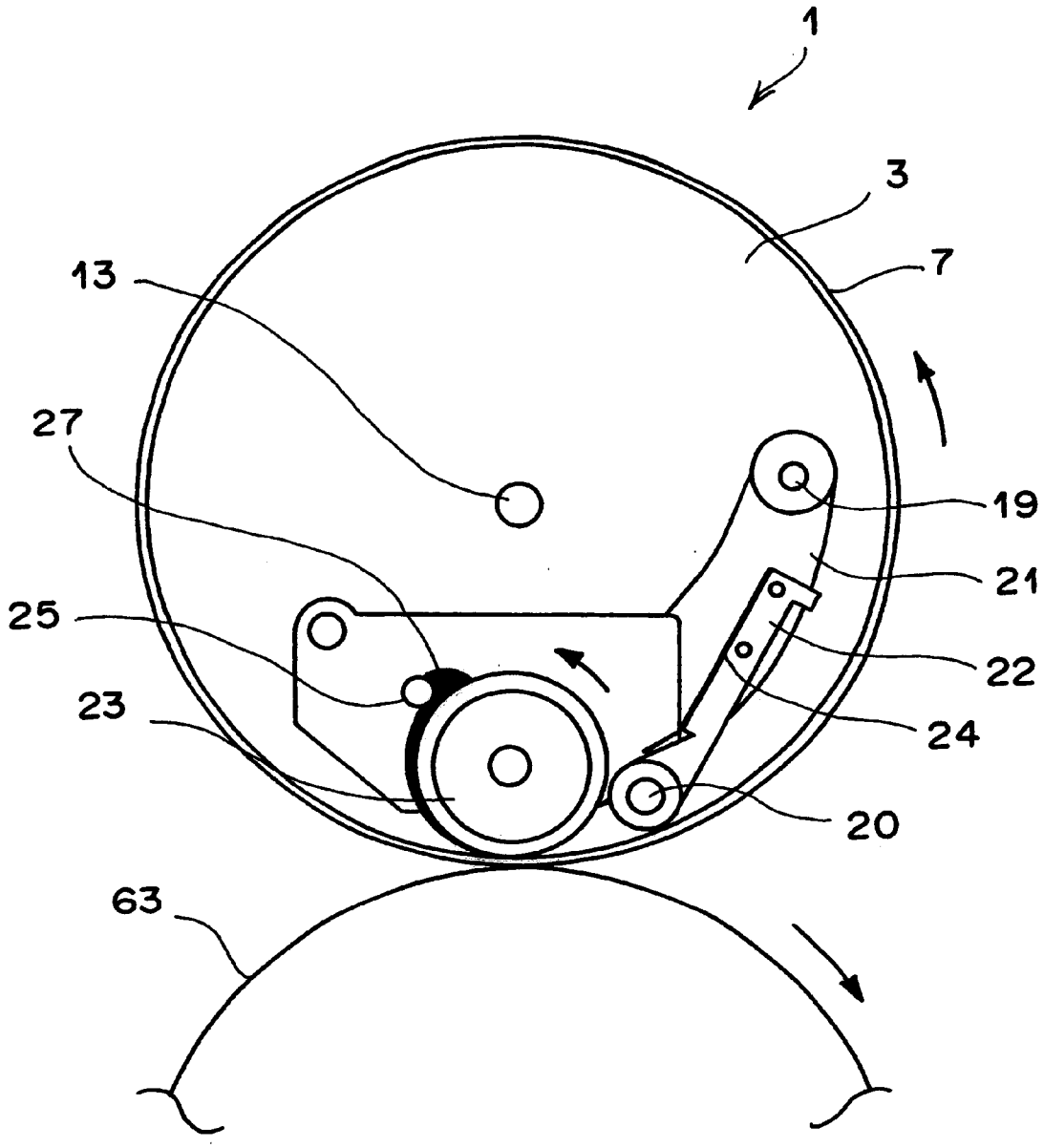
FIG. 4 is an enlarged side view of the printing drum of the stencil printer of the first embodiment.
Figure 5:
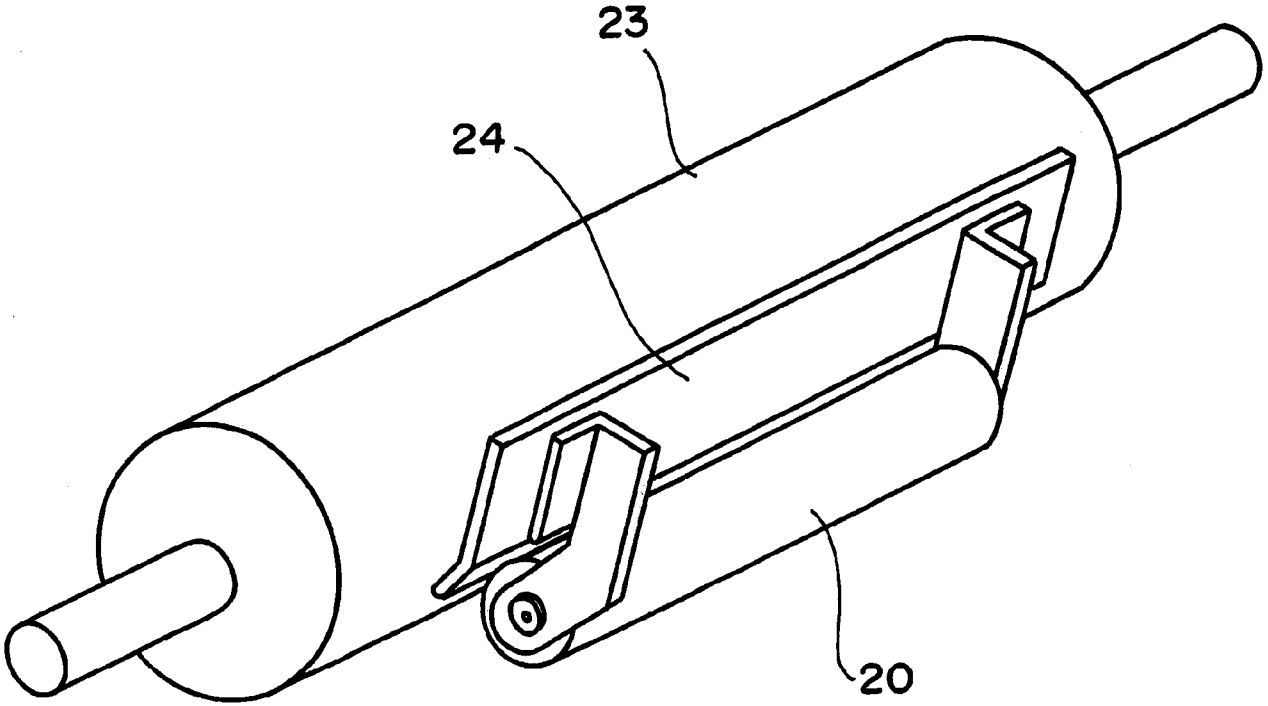
FIG. 5 is an enlarged perspective view of the squeegee roller and the support roller of the stencil printer of the first embodiment.

As shown in FIG. 4, an ink guard plate 24 is fixed to the roller support arms 21 to extend in parallel to the longitudinal axis of the squeegee roller 23. The ink guard plate 24 is disposed downstream of the contact line between the printing drum 1 and the squeegee roller 23 in the direction of rotation of the printing drum 1. The ink guard plate 24 is substantially equal to the squeegee roller 23 in length. Ink film is formed between the inner surface of the peripheral wall 7 of the printing drum 1 and the outer surface of the squeegee roller 23 and when the ink film is broken, ink splashes. The ink guard plate 24 is disposed to extend obliquely across splashing path of the ink.

Figure 3:
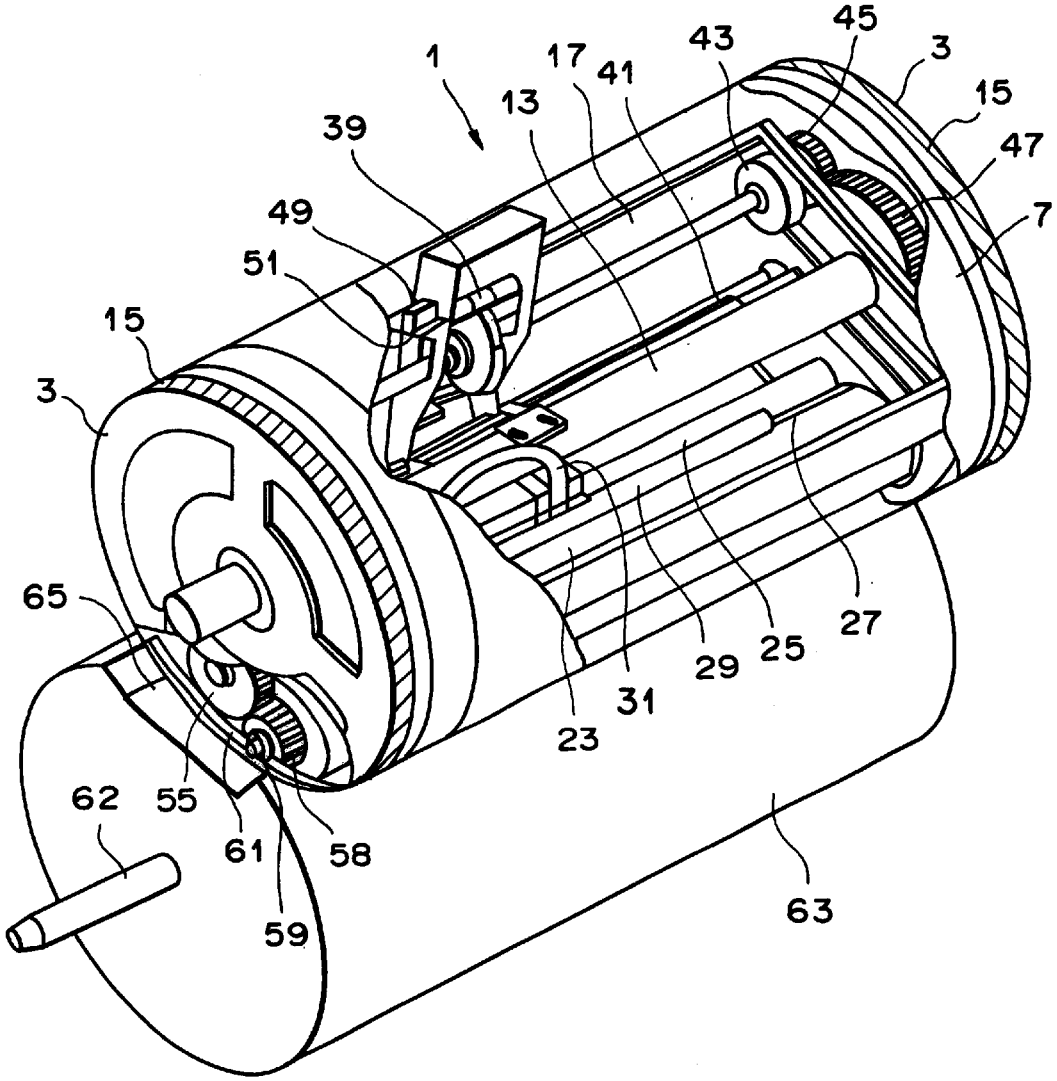
FIG. 3 is a perspective view partly cut away showing the printing drum and the paper pinch drum of the stencil printer of the first embodiment.

As shown in FIG. 4, a pair of mounting pieces 22 are fixed to the roller support arm 21 at its opposite ends and a retainer roller 20 is supported for rotation by the mounting pieces 22. In FIG. 3, the roller support arm 21 is omitted for the purpose of simplicity of the drawing.

Figure 6:
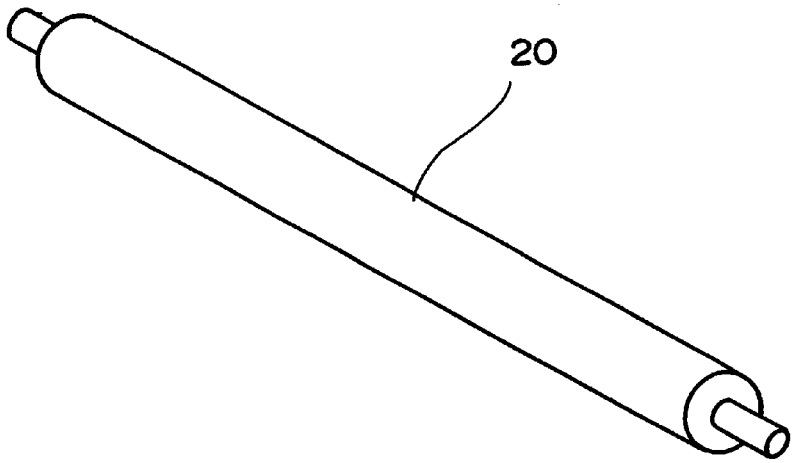
FIG. 6 is an enlarged perspective view of the support roller of the stencil printer of the first embodiment.

The retainer roller 20 retains the peripheral wall 7 not to be deformed upward by the squeegee roller 23. As shown in FIG. 6, in this particular embodiment, the retainer roller 20 is uniform in thickness and has a continuous circumferential surface in its longitudinal direction. The retainer roller 20 is substantially the same as the squeegee roller 23 in length and extends in parallel to the squeegee roller 23. The retainer roller 20 is disposed near the squeegee roller 23 and the inner surface of the peripheral wall 7 downstream of the contact line between the squeegee roller 23 and the inner surface of the peripheral wall 7 in the direction of rotation of the printing drum 1. The retainer roller 20 is not in contact with the peripheral wall 7 but is at an adequate distance from the peripheral wall 7. The retainer roller 20 may be either set free or driven in the same direction as the squeegee roller 23. The distance between the retainer roller 20 and the peripheral wall 7 is set to prevent deformation of the peripheral wall 7 in such a degree that can cause a problem.

When the retainer roller 20 is in contact with the peripheral wall 7, ink can sometimes leak outside the peripheral wall 7 where the retainer roller 20 is in contact with the peripheral wall 7. Since the retainer roller 20 employed in this particular embodiment is substantially cylindrical and is uniform in thickness over the entire length thereof, the retainer roller 20 will be brought into contact with the peripheral wall 7 over the entire length thereof when there is no distance between the retainer roller 20 and the peripheral wall 7, whereby the pressure applied to the peripheral wall 7 becomes too high and ink will leak outside the peripheral wall 7.

A cam shaft 33 is supported for rotation on the in-drum frame 17. The in-drum frame 17 is provided with a cam mechanism formed by a double-heart-shaped cam plate 35 fixed to the cam shaft 33 and a cam follower 39 mounted on a yoke member 37. The yoke member 37 is connected to the end of the roller support arm 21 by way of a pivot 41. Each time the cam plate 35 is rotated by 90°, the cam plate 35 alternately takes a printing position shown in FIG. 1 where it moves the squeegee roller 23 to an operative position where the squeegee roller 23 presses outward the peripheral wall 7 of the printing drum 1 and a non-printing position shown in FIG. 2 where it moves the squeegee roller 23 to an inoperative position where the squeegee roller 23 is kept away from the peripheral wall 7.

The cam shaft 33 is connected to a driven side of an electromagnetic clutch 43 and a drive side of the electromagnetic clutch 43 is connected to a cam shaft drive gear 45. The cam shaft drive gear 45 is in mesh with an in-drum main gear 47 and is driven by the main gear 47 in response to rotation of the printing drum 1.

A cam switch (a limit switch) 49 is mounted on the in-drum frame 17 and the cam switch 49 is actuated by an actuator 51 mounted on the yoke member 37 as shown in FIG. 3, thereby detecting whether the cam plate 35 is in the printing position or the non-printing position.

As shown in FIG. 1, a roller drive arm 53 is supported for rotation on the drum shaft 13 at an intermediate portion thereof. An intermediate gear 55 is supported for rotation on one end portion of the roller drive arm 53 and the other end portion of the roller drive arm 53 is connected to a tension spring 57 so that the roller drive arm 53 is urged in the counterclockwise direction. The intermediate gear 55 is in mesh with the in-drum main gear 47 and a gear 58 formed on one end portion of the squeegee roller 23 coaxially with the squeegee roller 23 under the force of the tension spring 57 and is rotated in response to rotation of the printing drum 1 to rotate the squeegee roller 23 in the same direction as the printing drum 1, i.e., in the counterclockwise direction.

When the squeegee roller 23 is rotated in the counterclockwise direction while the cam plate 35 is in the printing position and the squeegee roller 23 is held in the operative position shown in FIG. 1, the squeegee roller 23 presses outward the peripheral wall 7 of the printing drum 1 toward a paper pinch drum 63 to be described later.

Figure 2:
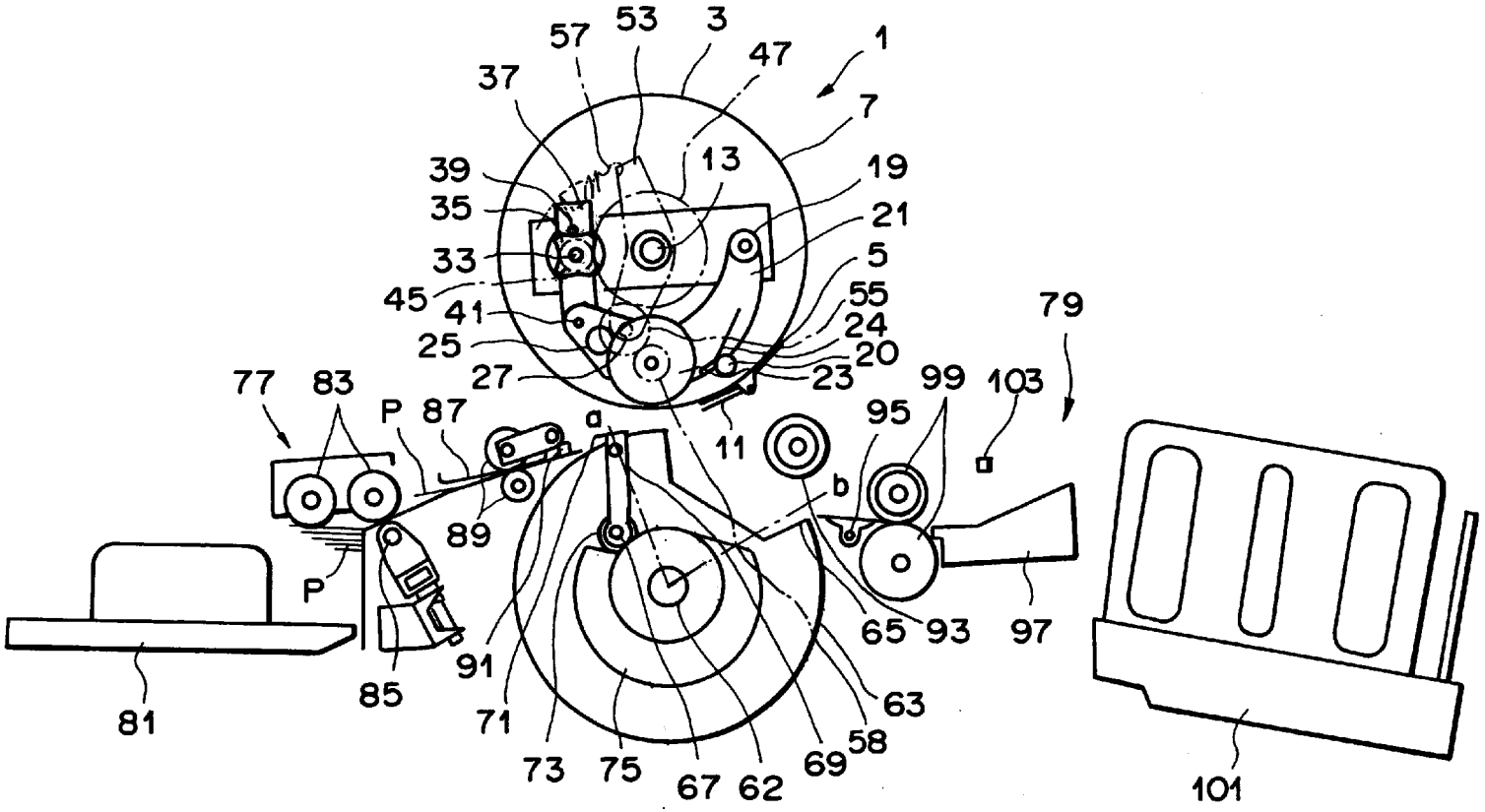
FIG. 2 is a schematic side view of the stencil printer of the first embodiment in a state where the squeege roller is in the inoperative position.

On the other hand, when the cam plate 35 is in the non-printing position and the squeegee roller 23 is held in the inoperative position shown in FIG. 2 where the squeegee roller 23 is kept away from the peripheral wall 7, the peripheral wall 7 is not deformed even if the squeegee roller 23 is rotated.

As shown in FIG. 3, a cam follower 59 is mounted on the squeegee roller 23 and is brought into contact with a cam 61 formed on the inner side surface of the printing drum 1. In an angular position where a recess 65 on the paper pinch drum 63 is faced toward the printing drum 1, the cam follower 59 abuts against the cam 61, whereby the cam follower 59 lifts, i.e., moves inward, the squeegee roller 23 away from the peripheral wall 7 of the printing drum 1 when the clamp base plate 5 comes to be below the squeegee roller 23 and the clamp base plate 5 is prevented from colliding against the edge of the recess 65. Thus the peripheral wall 7 is protected.

The paper pinch drum 63 is substantially the same as the printing drum 1 in outer diameter and is supported for rotation on a shaft 62 at a predetermined distance from the printing drum 1 in parallel thereto. The paper pinch drum 63 is rotated in the clockwise direction about the shaft 62 at a speed equal to the printing drum 1 by a synchronized drive unit (not shown). The paper pinch drum 63 is provided with the recess 65, which is for avoiding interference with the stencil master clamp mechanism of the printing drum 1.

The paper pinch drum 63 functions as the pinching means for pressing the printing paper against the printing drum 1 during printing.

As shown in FIG. 1, the part of the peripheral wall 7 deformed by the squeegee roller 23 is pressed against the paper pinch drum 63 with the stencil master and the printing paper P sandwiched therebetween. When the squeegee roller 23 is in the inoperative position, a space is formed between the printing drum 1 and the paper pinch drum 63 and the printing paper P can pass between the printing drum 1 and the paper pinch drum 63.

The paper pinch drum 63 is provided with a paper clamp member 67. The paper clamp member 67 is rotatably mounted on the paper pinch drum 63 by a pivot 69. A clamping piece 71 which is associated with the outer side surface of the paper pinch drum 63 to clamp a printing paper P is provided on one end of the clamp member 67 and a cam follower 73 is formed on the other end of the paper clamp member 67. The cam follower 73 is in contact with a fixed cam 75 and the clamping piece 71 is moved in synchronization rotation of the paper pinch drum 63 to clamp a leading end portion of the printing paper P, supplied from a paper supply section 77 to be described later, in an angular position of the paper pinch drum 63 indicated at a (paper clamping position) in FIG. 2 and to release the printing paper P in an angular position of the paper pinch drum 63 indicated at b (paper releasing position).

The stencil printer further comprises a paper supply section 77 and a paper discharge section 79. The paper supply section 77 comprises a paper supply table 81 on which a stack of printing papers P is placed, a pair of paper supply rollers 83 and a paper separator roller 85 for taking out the printing papers P from the paper supply table 81 one by one, a paper guide 87, a pair of timing rollers 89 which feeds at a predetermined timing the printing paper P to the paper clamping position a where the clamping piece 71 of the paper pinch drum 63 clamps the printing paper P, and an optical paper supply sensor 91 which detects that the printing paper P is fed to the paper clamping position a.

The paper discharge section 79 comprises a discharge pinch roller 93 which is disposed in the paper release position b and is associated with the paper pinch drum 63 to convey and discharge the printing paper P from the paper pinch drum 63, a paper scraper 95 which removes the printing paper P from the paper pinch drum 63, a pair of paper discharge pinch rollers 99 which discharge the printed paper to a paper chute 97, a paper discharge table 101 on which the printed papers are stacked, and an optical paper discharge sensor 103 which optically detects that the printed paper P is chuted from the paper chute 97 toward the paper discharge table 101.

The discharge pinch roller 93 and the upper one of the discharge pinch rollers 99 are brought into contact with the upper surface of the printing paper P, bearing thereon a printed image, only at opposite margins of the printing paper P. The positions of these rollers are automatically adjusted according to the size of the printing papers P on the paper supply table 81 detected by a paper size sensor (not shown) so that the rollers are brought into contact with the upper surface of the printing paper P only at opposite margins irrespective of the width of the printing paper P.

Operation of the stencil printer will be described, hereinbelow. First a stencil master is wound around the peripheral wall 7 of the printing drum 1. Then when a print start key on a control panel (not shown) is depressed, the printing drum 1 and the paper pinch drum 63 are start to rotate. As the printing drum 1 and paper pinch drum 63 start to rotate, a printing paper P is taken out from the paper supply table 81 by the paper supply rollers 83 and the paper separator roller 85 and fed toward the timing rollers 89 under the guidance of the paper guide 87.

When the printing drum 1 and the paper pinch drum 63 are rotated to a predetermined angular position, the timing rollers 89 feed the printing paper P to the paper clamping position a at a predetermined timing.

When the cam switch 49 is not on, the electromagnetic clutch 43 is energized for a predetermined time interval, whereby the cam plate 35 is rotated to the printing position. At this time, the actuator 51 actuates the cam switch 49, whereby that the cam plate 35 is in the printing position is detected. When the cam plate 35 is rotated to the printing position, the squeegee roller 23 is moved downward into abutment against the inner surface of the peripheral wall 7 of the.printing drum 1 as shown in FIG. 1. Then as the printing drum 1 is further rotated, the squeegee roller 23 presses the peripheral wall 7 radially outward and deforms the same toward the paper pinch drum 63.

When the printing paper P is supplied from the paper supply section 77 in synchronization with rotation of the paper pinch drum 63, the leading end of the printing paper P is clamped by the clamping piece 71 in the paper clamping position. As the paper pinch drum 63 rotates, the printing paper P is wound around the paper pinch drum 63 and is carried to the contact area of the printing drum 1 and the paper pinch drum 63, i.e., to the deformed part of the peripheral wall 7. Thus the printing paper P is pinched, together with the stencil master on the printing drum 1, between the deformed part of the printing drum 1 and the paper pinch drum 63 under a predetermined pressure. Printing is made on the printing paper P while the printing paper P is conveyed by rotation of the printing drum 1 and the paper pinch drum 63.

When the leading end of the printing paper P reaches the paper release position b, the printing paper P is released from the clamping piece 71 and delivered to the paper discharge pinch roller 93. Thereafter, the printing paper P is removed from the paper pinch drum 63 by the paper scraper 95 and is discharged to the paper chute 97 by the paper discharge pinch rollers 99. Thereafter the printing paper P is chuted onto the paper discharge table 101 with its printed surface facing upward.

In this embodiment, when a part of the peripheral wall 7 of the printing drum 1 is pulled inward as the squeegee roller 23 is rotated, the retainer roller 20 disposed near the inner surface of the peripheral wall 7 downstream of the contact line between the squeegee roller 23 and the inner surface of the peripheral wall 7 in the direction of rotation of the printing drum 1 prevents deformation of the peripheral wall 7.

Accordingly, behavior of the stencil master wound around the peripheral wall 7 is stabilized and the stencil master is prevented from being stretched or displaced in the circumferential direction of the printing drum 1. Further breakage of the peripheral wall and/or corrugation of the peripheral wall due to repeated stress can be prevented and durability of the peripheral wall 7 is increased. Further since the situation where the peripheral wall 7 resiles away from the squeegee roller 23 under its resiliency can be avoided, ink cannot splash the mechanisms in the printing drum 1. Further the ink guard plate 24 and the retainer roller 20 guard the mechanisms in the printing drum 1 from ink even if some ink should accidentally splash.

Figure 7:
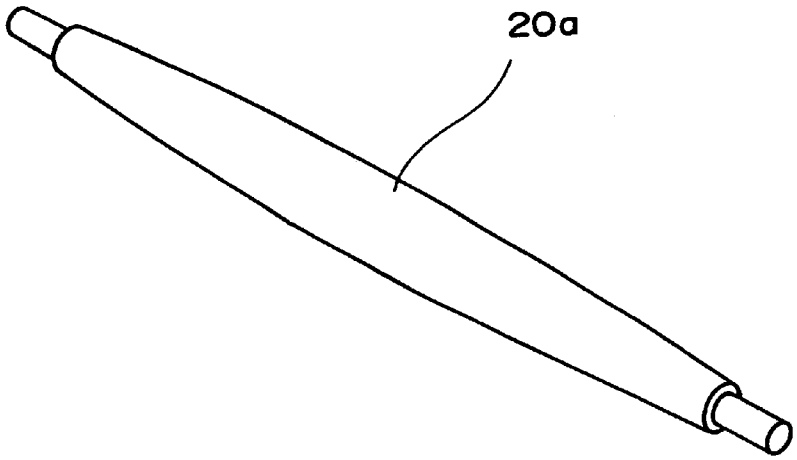
FIG. 7 is an enlarged perspective view of a modification of the support roller.
Figure 8:
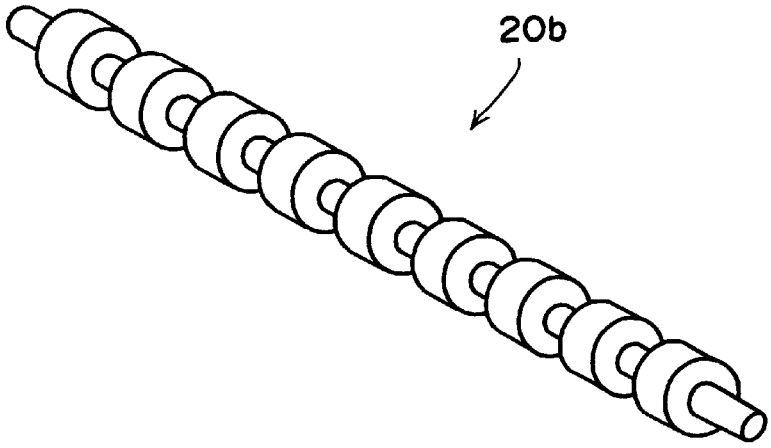
FIG. 8 is an enlarged perspective view of another modification of the support roller.
Figure 9:
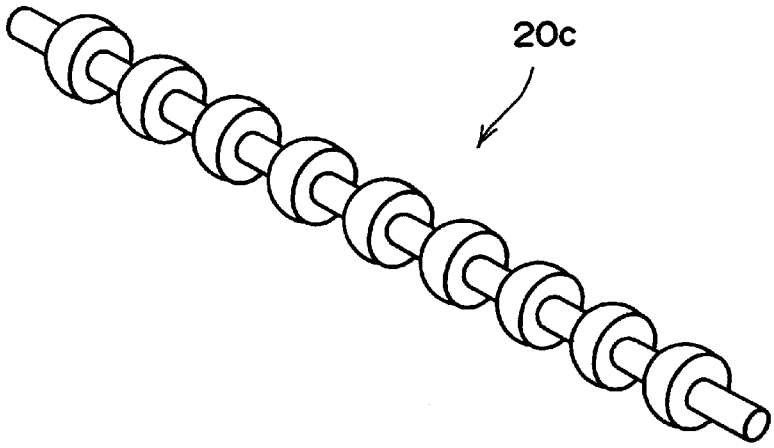
FIG. 9 is an enlarged perspective view of still another modification of the support roller.

FIGS. 7 to 9 show some modifications of the retainer roller 20 which can be employed in the present invention. The retainer roller 20*a* shown in FIG. 7 is substantially spindle-shaped. That is, the retainer roller 20*a* has a maximum thickness at the middle thereof and is tapered toward opposite ends. Since deformation of the peripheral wall 7 is maximized at the middle thereof, deformation of the peripheral wall 7 at the middle thereof can be effectively suppressed by use of the retainer roller 20*a* shown in FIG. 7. The retainer roller 20*a* shown in FIG. 7 may be shorter than the retainer roller 20 shown in FIG. 6. Further, in the retainer roller 20 shown in FIG. 7, since it is tapered toward the opposite ends, the opposite end portions are less apt to contact with the inner surface of the peripheral wall, whereby ink becomes less apt to leak at opposite ends of the peripheral wall 7.

The retainer roller 20*b* shown in FIG. 8 comprises a plurality of roller sections mounted coaxially with each other. In this retainer roller 20*b*, since the roller sections are spaced from each other and the outer surface of the retainer roller 20*b* is discontinuous, the retainer roller 20*b* contacts with the peripheral wall 7 over a smaller area, whereby leakage of ink can be suppressed.

The retainer roller 20*c* shown in FIG. 9 comprises a plurality of roller sections mounted coaxially with each other as in the retainer roller 20*b* shown in FIG. 8. The retainer roller 20*c* differs from the retainer roller 20*b* in that each roller section is spindle-shaped. This shape of the roller section contributes to further reducing the contact area between the retainer roller 20*c* and the peripheral wall 7, whereby leakage of ink can be suppressed more effectively. The contact area between the retainer roller 20*c* and the peripheral wall 7 can be further reduced when the length of the maximum diameter portion of each roller section is shortened.

A stencil printer with an internal press mechanism in accordance with a second embodiment of the present invention will be described with reference to FIG. 10, hereinbelow.

Figure 10:
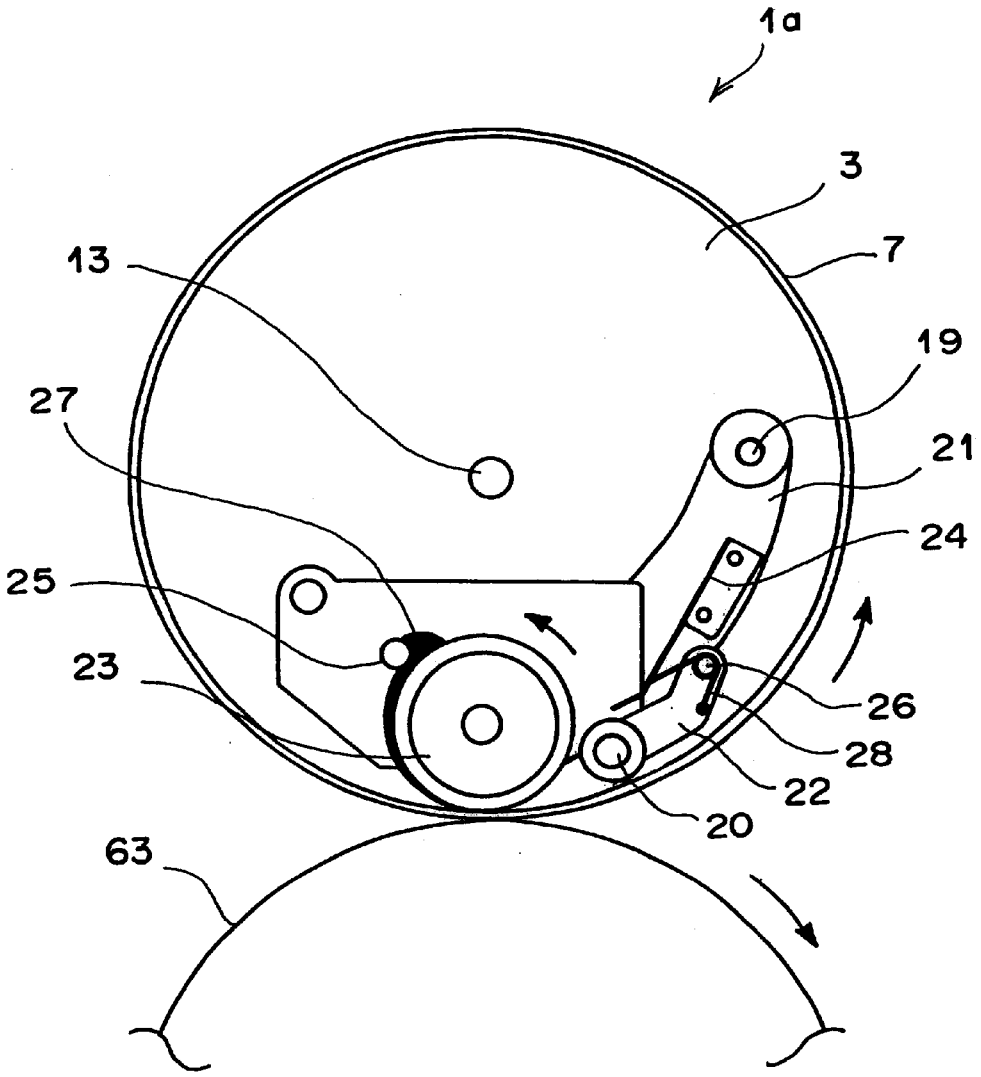
FIG. 10 is an enlarged side view of the printing drum of a stencil printer in accordance with a second embodiment of the present invention.

FIG. 10 shows only the printing drum 1*a* of the stencil printer of this embodiment. The part of the stencil printer of this embodiment not shown in FIG. 10 is the same as that in the first embodiment. The printing drum 1*a* and the paper pinch drum 63 of the stencil printer of this embodiment are basically the same in structure as those of shown in FIG. 4 and accordingly the elements analogous to those shown in FIG. 4 are given the same reference numerals and will not be described here. Further the difference of the printing drum 1*a* of this embodiment from that of the first embodiment will be mainly described, hereinbelow.

In this embodiment, the mounting structure of the retainer roller 20 differs from that in the first embodiment. As shown in FIG. 10, mounting pieces 22 are mounted for rotation on the roller support arm 21 by pivots 26 at their one ends. The pivot 26 is positioned between the squeegee roller 23 and the pivot shaft 19 below the ink guard plate 24. The retainer roller 20 is supported for rotation on the other ends of the mounting pieces 22. A coiled torsion spring 28 which is connected to the ink guard plate 24 at one end and to the mounting piece 22 at the other end is fitted on the pivot 26 and urges downward the retainer roller 20. The retainer roller 20 is the same in structure as that employed in the first embodiment. The retainer roller 20 is normally held near the squeegee roller 23 and the inner surface of the peripheral wall 7 downstream of the contact line between the squeegee roller 23 and the inner surface of the peripheral wall 7 in the direction of rotation of the printing drum 1*a* under the force of the coiled torsion spring 28.

As in the first embodiment, the retainer roller 20 suppresses deformation of the peripheral wall 7 of the printing drum l*a*. However in this embodiment, the retainer roller 20 can be displaced upward while pressing the peripheral wall 7 under the force of the spring 28 when the force applied from the peripheral wall 7 is large.

Figure 11:
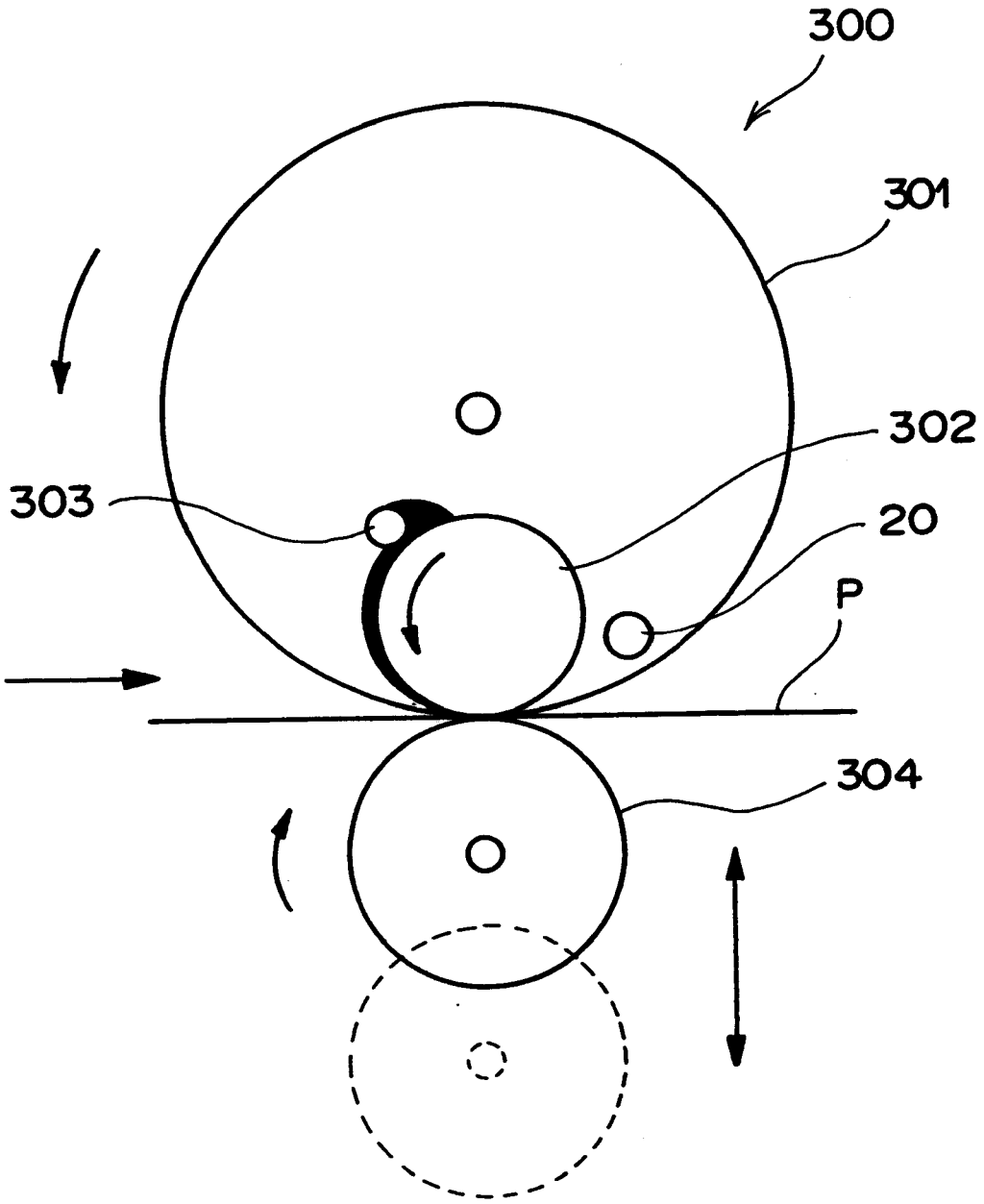
FIG. 11 is a schematic side view of a stencil printer in accordance with a third embodiment of the present invention.
Figure 12:
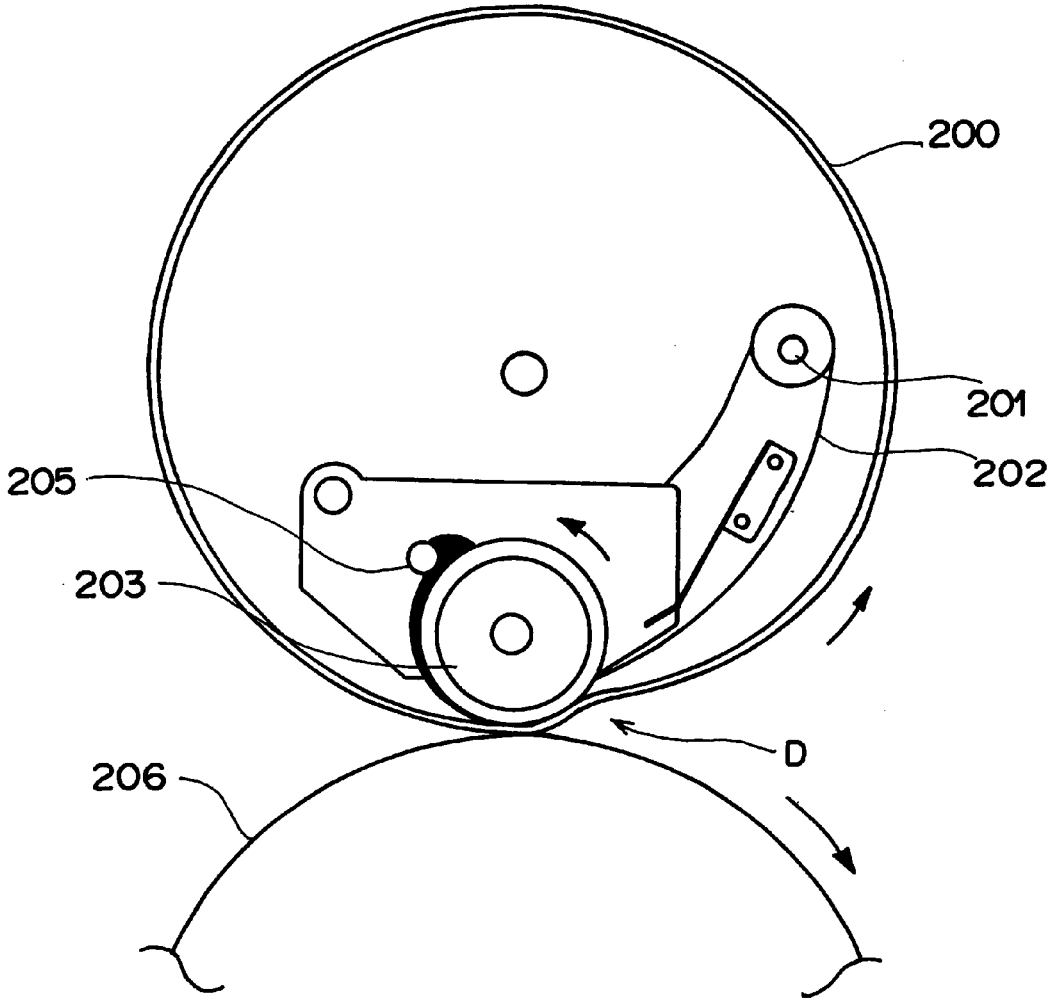
F I G .12 PRIOR ART
FIG. 12 is a schematic side view of a conventional stencil printer.

FIG. 11 is a view similar to FIG. 10 but shows a stencil printer in accordance with a third embodiment of the present invention. In this embodiment, an external press roller 304 is moved up and down toward and away from printing drum 300 to pinch therebetween the printing paper P.

The printing drum 300 has a rigid and ink-permeable peripheral wall 301. A squeegee roller 302 and a doctor roller 303 are disposed inside the printing drum 300. An external press roller 304 as a pinching means is disposed below the printing drum 300 to be movable up and down and is rotated in a direction opposite to the direction of rotation of the printing drum 300 in synchronization therewith.

Printing is effected while the printing paper P is conveyed pinched between the printing drum 300 and the external press roller 304.

In this embodiment, a retainer roller 20 is mounted on a frame (not shown) in the printing drum 300 in the same manner as in the first embodiment. The retainer roller 20 may be mounted for rotation as in the second embodiment.

What is claimed is:

1. A stencil printer comprising a printing drum which has an ink-permeable peripheral wall, around which a stencil master is wound and to an inner surface of which the ink is supplied, and is rotated about its longitudinal axis, an internal press roller which is disposed inside the printing drum and is in contact with the inner surface of the peripheral wall of the printing drum, a pinching means which is disposed outside the printing drum and carries a printing paper for pinching the printing paper between the pinching means and the stencil master wound around the peripheral wall, and a retainer roller which is disposed in a predetermined position near the internal press roller and the inner surface of the peripheral wall downstream of a contact line between the internal press roller and the inner surface of the peripheral wall and downstream of a final nip region formed between the pinching means and the printing drum in a direction of rotation of the printing drum.

2. A stencil printer as defined in claim 1 in which said internal press roller is mounted on a rotatable member disposed inside the printing drum to be movable, in response to rotation of the rotatable member, between an inoperative position where it is away from the peripheral wall of the printing drum and an operative position where it presses outward the peripheral wall, said pinching means is a rotatable paper pinch drum which is disposed outside the printing drum at such a distance from the printing drum that the printing paper is pinched between the peripheral wall of the printing drum and the paper pinch drum when the internal press roller deforms outward the side, and said retainer roller is mounted for rotation on the rotatable member.

3. A stencil printer as defined in claim 1 in which said internal press roller is mounted on a rotatable member disposed inside the printing drum to be movable, in response to rotation of the rotatable member, between an inoperative position where it is away from the peripheral wall of the printing drum and an operative position where it presses outward the peripheral wall, said pinching means is a rotatable paper pinch drum which is disposed outside the printing drum at such a distance from the printing drum that the printing paper is pinched between the peripheral wall of the printing drum and the paper pinch drum when the internal press roller deforms outward the side, and said retainer roller is mounted for rotation on a rotatable arm which is mounted for rotation on the rotatable member and is urged by an urging means toward the inner surface of the peripheral wall of the printing drum.

4. A stencil printer as defined in claim 1 in which said pinching means is an external press roller which is movable up and down between an operative position in which it is pressed against the peripheral wall of the printing drum with a printing paper pinched therebetween and an inoperative position where it is away from the printing drum, and said retainer roller is supported for rotation.

5. A stencil printer as defined in claim 1 in which said pinching means is an external press roller which is movable up and down between an operative position in which it is pressed against the peripheral wall of the printing drum with a printing paper pinched therebetween and an inoperative position where it is away from the printing drum, and said retainer roller is movable upward from the predetermined position and is urged toward the predetermined position.

6. A stencil printer as defined in claim 1 in which said retainer roller is normally spaced from the inner surface of the peripheral wall.

7. A stencil printer as defined in claim 1 in which said retainer roller is rotated in the same direction as the internal press roller.

8. A stencil printer as defined in claim 1 in which said retainer roller is a cylindrical member having a uniform outer diameter.

9. A stencil printer as defined in claim 1 in which said retainer roller is spindle-shaped.

10. A stencil printer as defined in claim 1 in which said retainer roller comprises a plurality of roller sections which are coaxially mounted.

* * * * *